US006851924B2

(12) United States Patent
Mazzola et al.

(10) Patent No.: US 6,851,924 B2
(45) Date of Patent: Feb. 8, 2005

(54) CRACK-RESISTANCE VANE SEGMENT MEMBER

(75) Inventors: Stefan Mazzola, Sanford, FL (US); Keith L. Nickols, Winter Park, FL (US); Friedrich Rogers, West Palm Beach, FL (US); W. David Day, Jupiter, FL (US); Kelly M. Flannery, Juno Beach, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 28 days.

(21) Appl. No.: 10/259,869

(22) Filed: Sep. 27, 2002

(65) Prior Publication Data

US 2004/0062636 A1 Apr. 1, 2004

(51) Int. Cl.[7] ..... F01D 9/06
(52) U.S. Cl. ..... 415/115; 416/97 R; 416/234
(58) Field of Search ..... 415/115, 116; 416/96 R, 97 R, 97 A, 228, 234, 235, 239, 248, 214 A, 193 A

(56) References Cited

U.S. PATENT DOCUMENTS 6,132,169 A * 10/2000 Manning et al. ..... 415/115
6,190,128 B1 * 2/2001 Fukuno et al. ..... 416/96 R

* cited by examiner

*Primary Examiner*—F. Daniel Lopez
*Assistant Examiner*—Dwayne J White

(57) ABSTRACT

A crack-resistant vane segment assembly member for an industrial turbine engine is disclosed. The vane segment includes at least one internally-cooled body portion and inner and outer shroud portions. The body portions include end regions characterized by blending and transition zones that ensure heat is transferred at a non-crack-inducing rate from the shroud portions to the body portions. The vane segment assembly also includes a cooling arrangement that reduces the impact of thermal gradient-induced stresses acting at the interface between the body portions and shroud portions. The cooling arrangement cooperates with the transition and blending zones to produce synergistically-enhanced crack resistance properties.

16 Claims, 6 Drawing Sheets

CRACK-RESISTANCE VANE SEGMENT MEMBER

FIELD OF THE INVENTION

This invention relates generally to the field of internal to combustion engines and, more particularly, to a crack-resistant vane assembly member.

BACKGROUND OF THE INVENTION

Combustion engines are machines that convert chemical energy stored in fuel into mechanical energy useful for generating electricity, producing thrust, or otherwise doing work. These engines typically include several cooperative sections that contribute in some way to the energy conversion process. In gas turbine engines, air discharged from a compressor section and fuel introduced from a fuel supply are mixed together and burned in a combustion section. The products of combustion are harnessed and directed through a turbine section, where they expand and turn a central rotor shaft. The rotor shaft may, in turn, be linked to devices such as an electric generator to produce electricity.

To increase efficiency, engines are typically operated near the limits of the engine components. For example, to maximize the amount of energy available for conversion into electricity, the products of combustion (also referred to as the working gas or working fluid) often exit the combustion section at high temperature and velocity. This elevated temperature and velocity generates a large amount of potential energy, but also places a great deal of stress on the downstream components, such as the blades and vanes of the turbine section.

The above-mentioned turbine section typically includes matched blades and vanes which are grouped together into coordinating sets known as "stages". These blades and vanes have airfoil-shaped body regions and include end shrouds that help fix them in place inside an engine. Several, typically four, axially-spaced stages of matched blades and vanes cooperatively interact with the hot working fluid, which is forced at high speed through the turbine section, to spin the rotor shaft. Over time, exposure to the working gas elevated temperature and velocity may lead to component failure.

The first two stages of blades and vanes in an industrial gas turbine engine are exposed to a stream of working fluid that is extremely hot (above 2000° F.) and moving very quickly (above 500 ft/s). The blades and vanes in this environment must tolerate not only extreme thermal loads, but high-magnitude dynamic loads, as well. As a result, these components are traditionally rugged, internally-cooled structures that often include external thermal barrier coatings.

Unfortunately, while robust architecture and barrier coatings help the blades and vanes withstand external thermal and mechanical loads, they do not address all of the issues associated with exposure to the working fluid. For example, non-uniform temperature distribution between the cooled airfoil portions and relatively hot shroud portions introduces thermal gradients that produce internal thermal stresses. Cooling channel exits also produce localized thermal stresses, by inducing thermal gradients in the areas immediately surrounding the exits, as a result of sharp drops in temperature.

These internal stresses act in addition to the existing external thermal and mechanical loads to produce an elevated amount of composite stress within the blades and vanes. That is, external thermal stress due to the extreme heat of the working fluid, mechanical stresses due to the extreme velocity of the working fluid, and internal thermal stress due to thermal gradients within the vane segment all contribute the overall, composite stress level in this region. If this cumulative or "composite" stress at a given point exceeds a threshold amount, component failure may be accelerated or spontaneously induced. Therefore, even if external thermal and mechanical stress levels are kept below corresponding individual limits, the aggregate impact of these stresses, along with thermal-gradient-induced internal stresses, at a given point may be high enough produce to component failure. Accordingly, although modern blades and vanes are typically able to withstand external thermal and mechanical loads, additional internal loads induced by thermal gradients may, as a group, produce "composite" stress levels that exceed a failure-inducing threshold value.

One particular problem is the amount of composite stress concentrated in vane segments at the interface between the shroud portions and airfoil-shaped body portions due to typically-high levels of stress from three distinct sources that act in a cumulative manner in this region: external thermal stresses and mechanical stresses (induced by direct interaction with the working fluid), and internal thermal stresses (induced by thermal gradients within the vane).

Although thermal gradients may be present to a certain degree in many engine components, they are especially prevalent in the vanes of the turbine second stage or row. Row two vanes are often mounted in a cantilevered fashion to permit free rotation of the engine rotor shaft, with an outer end attached to the turbine casing and an inner end that is left free. This makes these vanes prone to cracking issues, because they must, without being supported at both ends, still withstand the extreme mechanical and thermal loads induced by the working fluid. As a result, of this requirement, row two vane segments are often especially robust. For example, to provide the stiffness required to withstand forces transmitted by the working fluid, row two vane segments may span two or more airfoils and typically include end shrouds that are particularly thick. Unfortunately, while this type of arrangement helps the vane segments withstand external loads, the increased rigidity (actually)/tends to make these components more susceptible to thermal gradients and the stresses associated therewith. Various approaches have been taken to reduce the presence of thermal gradients in second row vanes, with each approach achieving varying degrees of success.

The external thermal and mechanical loads introduced on engine components result largely from the of operating conditions required to meet power output demands. These components of composite stress are, accordingly, not easily reduced without negatively impacting engine performance. As a result, lowering thermal and mechanical loads is not a viable approach to reducing composite stress levels. Accordingly, addressing the internal thermal gradient stress represents the only practical means for reducing overall, composite stress levels.

Thermal-gradient-induced stresses come largely as a result of interaction between hot regions and cool regions within a given component, as engine the component seeks to reach thermal equilibrium. Therefore, there are three main factors which influence the impact of thermal gradients: the amount of heat which must be transferred and the area available for transfer of heat and the thickness/length of the feature.

As noted above, the amount of heat which needs to be transferred between regions of a component is one of three key factors that impact the affect of thermal gradients. One way to reduce this amount is simply to reduce the overall operating temperature of the engine. A second way is to increase the amount of internal cooling that is used. While each of these approaches may be used to partially reduce the overall amount of heat transferred within second row turbine vanes, both methods have drawbacks. For example, lowering the overall operating temperature reduces the temperature within the vanes, but reduces the energy available for conversion into electricity. Similarly, although increasing the use of internal cooling may lower the amount of heat remaining to be dissipated within a given vane, this approach may also dramatically reduce operating efficiency. Furthermore, increasing the amount of internal cooling may also create additional internal stresses by introducing additional localized thermal loads due to local thermal gradients surrounding the cooling locations. For a variety of reasons, reducing the amount heat to be transferred is often not a feasible approach to reducing thermal gradient stress.

As also noted above, the rate at which heat is transferred between component regions is a second factor that affects the impact of thermal gradients: excessive rates of heat transfer lead to cracking, while more moderate rates of transfer allow for extended part life. One way to reduce heat transfer rate is to increase the area of contact between hot and cold regions, such as by providing filleted joints where regions of disparate temperature meet. Fillets are used because, in addition to providing extra contact useful for heat transfer, their geometry reinforces the vane against the mechanical stresses that tend to induce cracks along right-angled or other non-curved joints.

The use of fillets to increase mass as a way to lower heat transfer rates has a practical limit in this environment, however. A fillet having enough mass to effectively reduce heat transfer rates becomes so large that it may actually store heat, rather than dissipate it. A further drawback to the "enlarged fillet" approach lies in the need to ensure proper airflow through the turbine section. Adding material to the vane segment may disrupt the aerodynamics of the vane profile, thereby disturbing airflow through the turbine and reducing the efficiency of the energy conversion process.

Therefore, there remains a need in this art for a crack resistant vane segment that maintains composite stress levels that are below an accepted threshold value. The vane segment should maintain this acceptable level of composite stress by reducing heat transfer rates without storing heat or negatively impacting vane aerodynamics. In addition, the vane segment should address thermal gradient issues without sacrificing performance. To this end, the vane segment should provide a cooling arrangement that lowers internal thermal stresses without requiring performance-inhibiting temperature reductions, without increasing the amount of cooling fluid used, and without introducing thermal gradients.

SUMMARY OF THE INVENTION

The present invention is a vane segment assembly for a combustion engine that has increased crack resistance properties and is particularly effective to ensure that composite stress levels within shroud/body portion interfaces are below failure-inducing thresholds. In particular, the vane segment of the present invention reduces internal thermal stress due to thermal gradients near the shroud/body portion interfaces, a region of particularly-high external thermal and mechanical stresses, without requiring performance-reducing efforts.

The vane segment assembly includes features that reduce the rate at which heat is transferred between the vane shrouds and body portions and a cooling scheme that reduces localized thermal gradient stresses in that region.

The vane segment of the present invention includes at least one body portion with a first end region spaced apart from a second end region by a mid region. The end regions each includes a transition zone and a blending zone, with zone having a distinct outer contour. The vane segment assembly includes shroud portions adjacent end regions and a cooling chamber disposed within said body portion. The cooling chamber has a cooling channel entrance and is characterized by several cooling channels. At least one of the cooling channels have cooling exits in fluid communication with the end regions; other cooling channels have exits in communication with the mid region.

By combining these features in one component, the vane segment assembly of the present invention strategically manages the internal thermal stresses introduced by exposure to working fluid, thereby substantially reducing crack formation and increasing part life.

Accordingly, it is an object of the present invention to provide a vane segment assembly that maintains the composite thermal stress at or below a cracking threshold level.

It is a further object of the present invention to provide a vane segment assembly that transfers internal heat at a moderate rate, without storing heat or negatively impacting the aerodynamics of the turbine section.

It is an additional object of the present invention to provide a vane segment assembly that provides effective cooling without negatively impacting the amount of potential energy available for energy conversion.

It is also an object of the present invention to provide a vane segment assembly that shifts internal thermal stress away from body portion/shroud interfaces Other objects and advantages of this invention will become apparent from the following description taken in conjunction with the accompanying drawings wherein are set forth, by way of illustration and example, certain embodiments of this invention. The drawings constitute part of this specification and include exemplary embodiments of the present invention and illustrate various objects and features thereof.

DETAILED DESCRIPTION OF THE INVENTION

Reference is made to the Figures, generally, in which a vane segment assembly 10 according to the present invention is shown. The vane segment assembly 10 includes features that moderate the rate at which heat is transferred between internally-cooled airfoil body portions 14 and relatively-hot shroud portions 16,18, thereby keeping the transfer rate below a threshold value. The vane segment assembly 10 also includes and a cooling scheme which minimizes the impact of localized thermal gradients in regions where other stresses, including external thermal and mechanical stresses, are especially high, particularly within the shroud/airfoil interface regions 48,50. With this arrangement, the vane segment assembly 10 of the present invention ensures that "composite" stress levels remain below acceptable threshold values within the vane segment assembly, without negatively impacting engine efficiency or performance.

Figure 1:
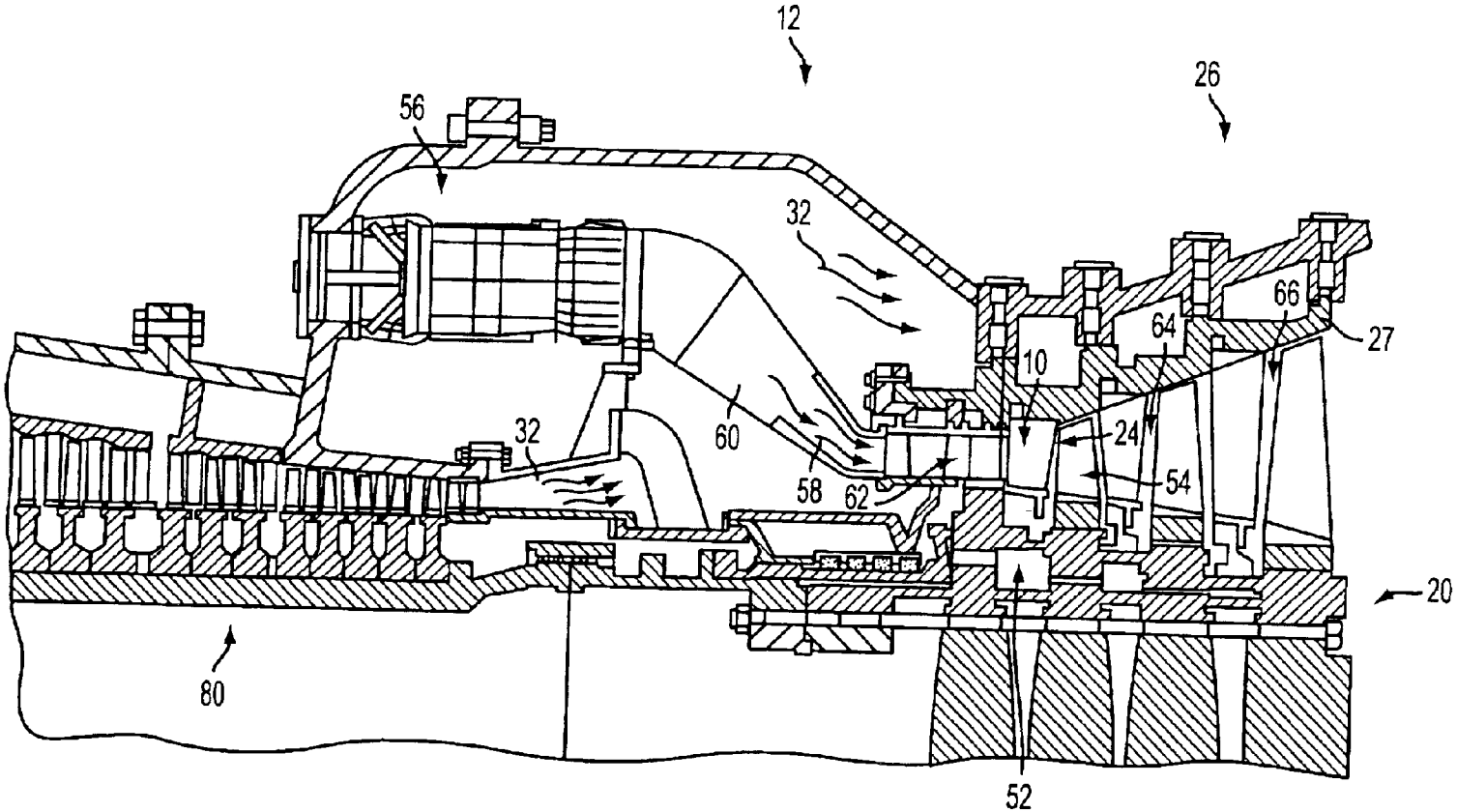
FIG. 1 is a schematic representation of the vane segment assembly of the present invention in use in an industrial turbine combustion engine.

By way of overview, and with particular reference to FIG. 1, the vane segment assembly 10 is shown in use in an industrial gas turbine engine 12. The vane segment assembly 10 of the present invention includes airfoil-shaped body portions 14 that extend radially between two rigid shroud portions 16,18. The outer and inner shrouds 16,18 are joined with the corresponding body portion end regions 38,40 along corresponding interfaces 48,50, shown most clearly in FIGS. 2A and 3A. It is noted that the shroud portions 16,18 need not be distinct from the body portions 14, and may be formed integral therewith.

In preparation for use, several, for example between twenty and thirty, vane segment assemblies 10 are linked together to form a blade ring assembly 52 of vanes which will cooperate with a corresponding set 54 of blades to form one, for example the second, of several stages 62, 24, 64, 66 of turbine blades and vanes. When the vane segment assemblies 10 are installed in an engine 12, the outer shroud portion 16 is mounted adjacent the outer wall 27 of the engine turbine section 26; the inner shroud portion 18 is oriented toward the engine shaft 20.

During engine operation, combustion in a combustor section 56 of the engine 12 produces hot, gaseous products of combustion 58 which travel through a transition section 60 and enter the turbine section 26. As the products of combustion 58 pass through the turbine section 26, they flow at high temperature (above 2000° F.) and high velocity (above 500 ft/s) past the various stages 62, 24, 64, 66 of blades and vanes. These gasses 58 act as a working fluid, impinging upon the components of the turbine stages 62, 24, 64, 66, and causing an associated rotor shaft 20 to spin. In applications where production of electricity is desired, the shaft 20 is preferably linked to a generator (not shown). The vane segment assembly 10 of the present invention will now be described in detail.

Figure 2A:
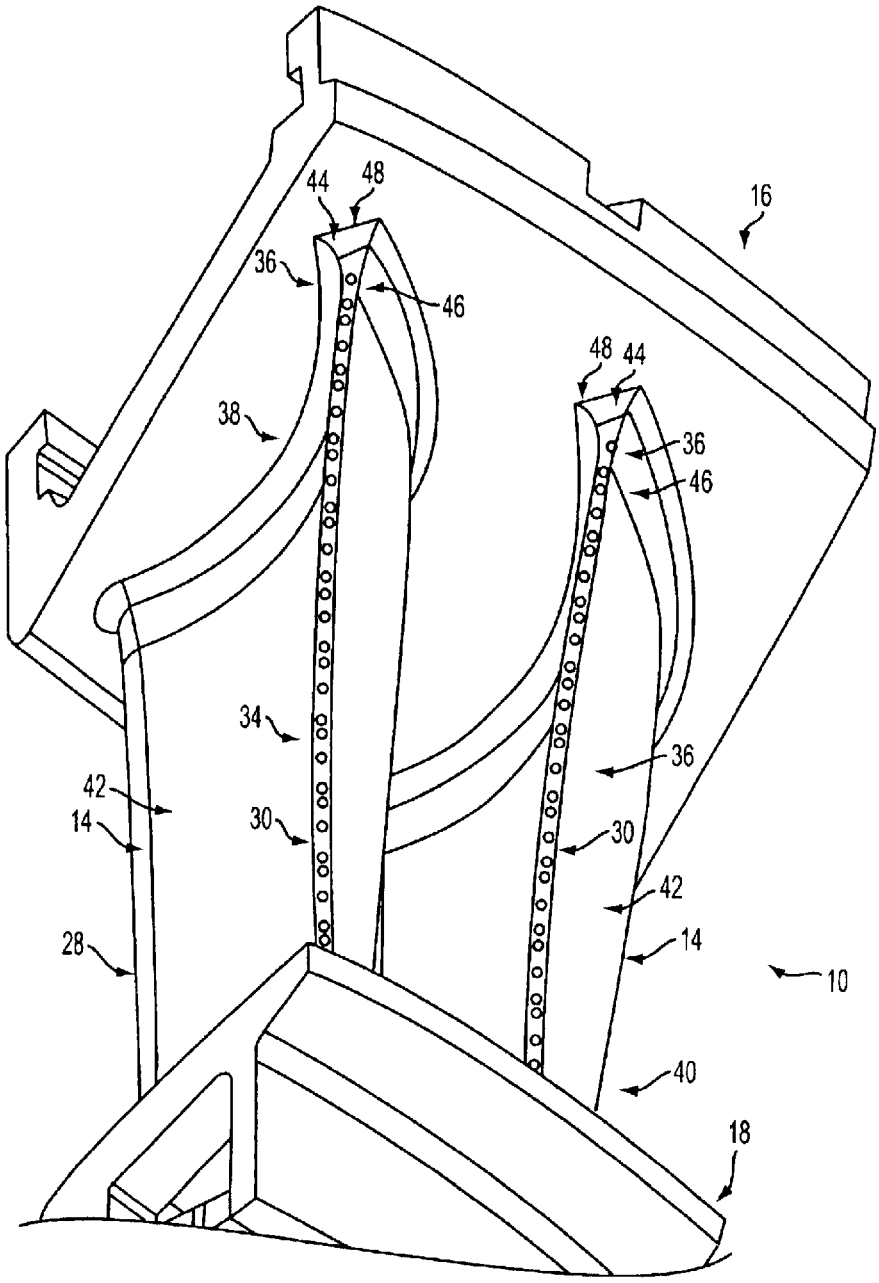
FIG. 2A is an isometric representation of the vane segment assembly of the present invention shown in FIG. 1.
Figure 2B:
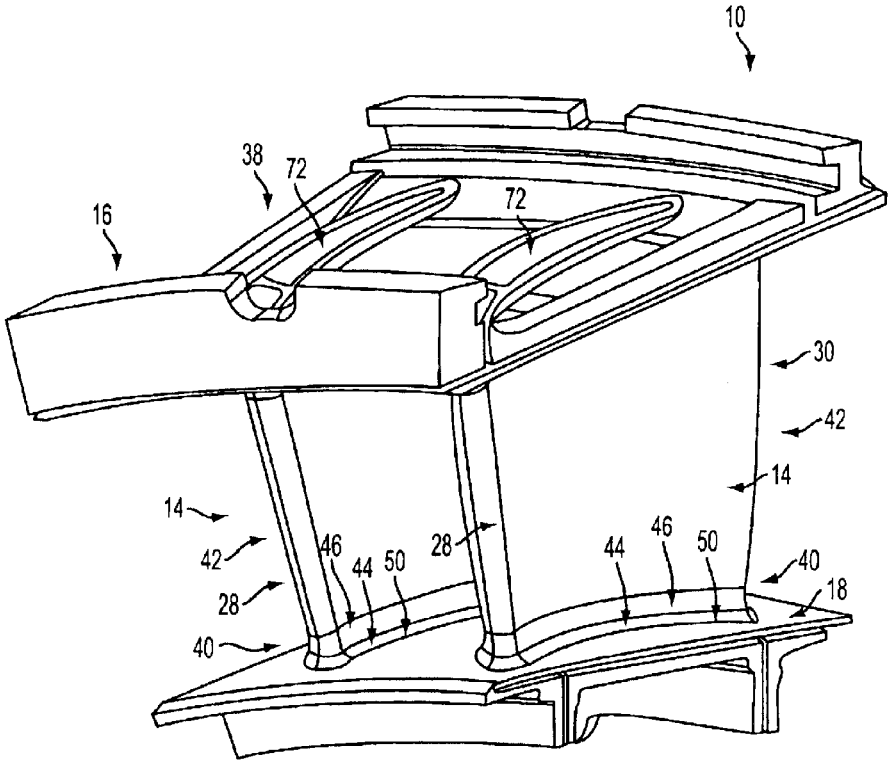
FIG. 2B is an alternate isometric view of the vane segment assembly that is shown in FIG. 2A.

In one embodiment, seen with reference to FIGS. 2A and 2B, the vane segment assembly 10 of the present invention includes two body portions 14. The body portions 14 are preferably identical; in the interest of clarity, only one will be described. The body portion 14 is an elongated, airfoil-shaped structure having a leading edge 28 and an opposite trailing edge 30. The vane segment body portion 14 also includes a first end region 38 and a second end region 40, with the end regions being spaced apart by a mid region 42 that extends therebetween. Inner and outer shroud portions 16,18 keep the body portions 14 fixed in place. The vane segment assembly 10 is preferably made from materials exhibiting enhanced low cycle fatigue properties, such as IN939 or ECY768. Other suitable materials, such as X45 may also be used, but IN939 is particularly suited for use in notched areas, such as internally-cooled vanes segments, like that of the present invention 10. It is noted that the vane segment assembly 10 need not include two body portions 14; more, or fewer, body portions may be used as desired.

As noted above, the vane segment assembly 10 of the present invention ensures heat is transferred at a moderate rate between the body portions 14 and shroud portions 16,18. More particularly, the vane segment assembly 10 reduces the impact of thermal gradients by providing an optimized area of contact between the body portions 14 and shroud portions 16,18. One embodiment of this feature is seen in FIG. 3, in which each of the end regions 38,40 is characterized by two zones 44, 46 that have distinct, strategically-selected outer contours 74,76. More particularly, the end regions 38,40 each include a transition zone 44, located adjacent the corresponding shroud portion 16,18, and a blending zone 46, located between the transition zone and the body portion mid region 42. As described more fully below, the transition and blending zones 44,46 cooperatively reduce the rate of heat transfer around the shroud portion/blade interface regions 48,50, without inducing additional stresses in those regions or disrupting airflow.

Figure 3A:
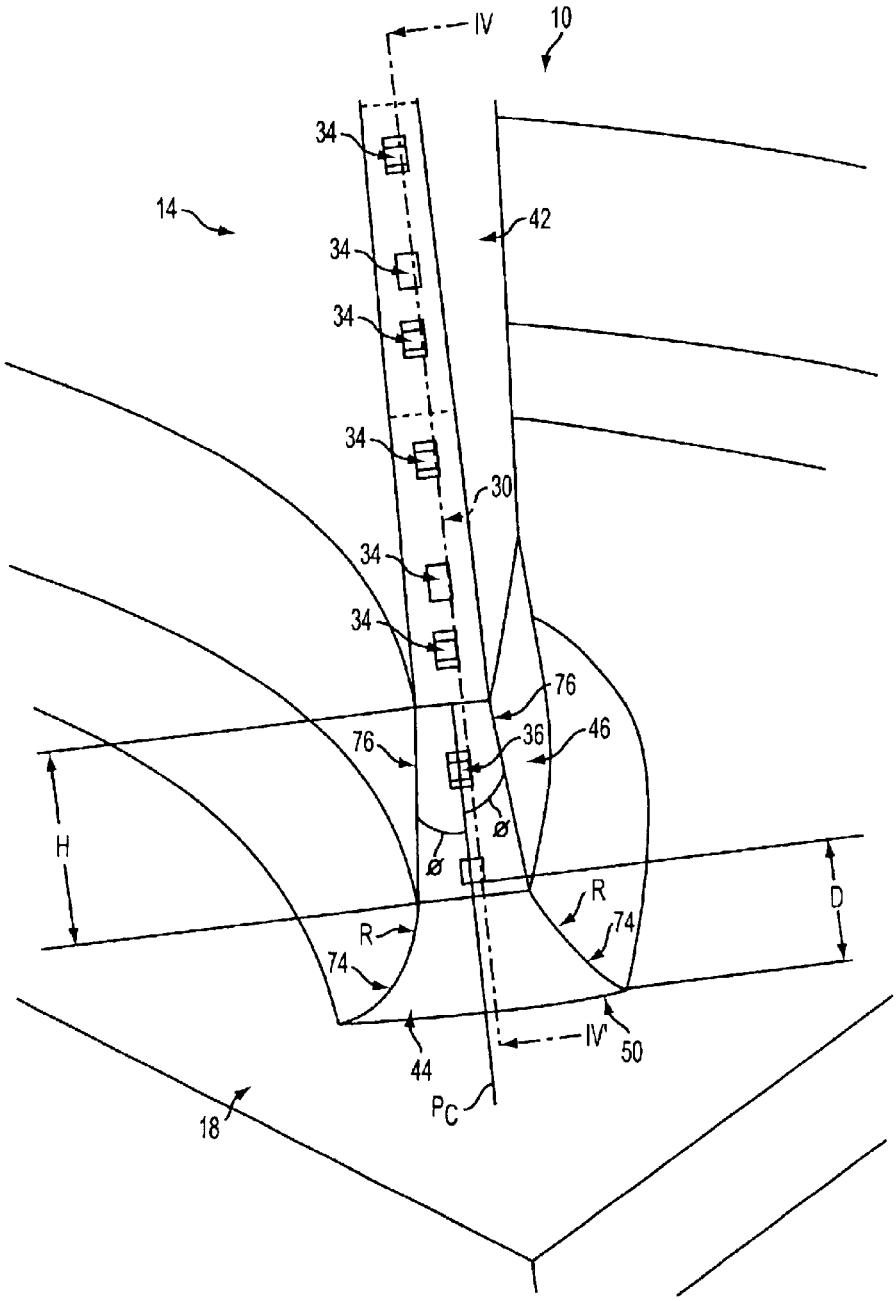
FIG. 3A is a partial end elevation view of the vane segment assembly that is shown in FIG. 1.
Figure 3B:
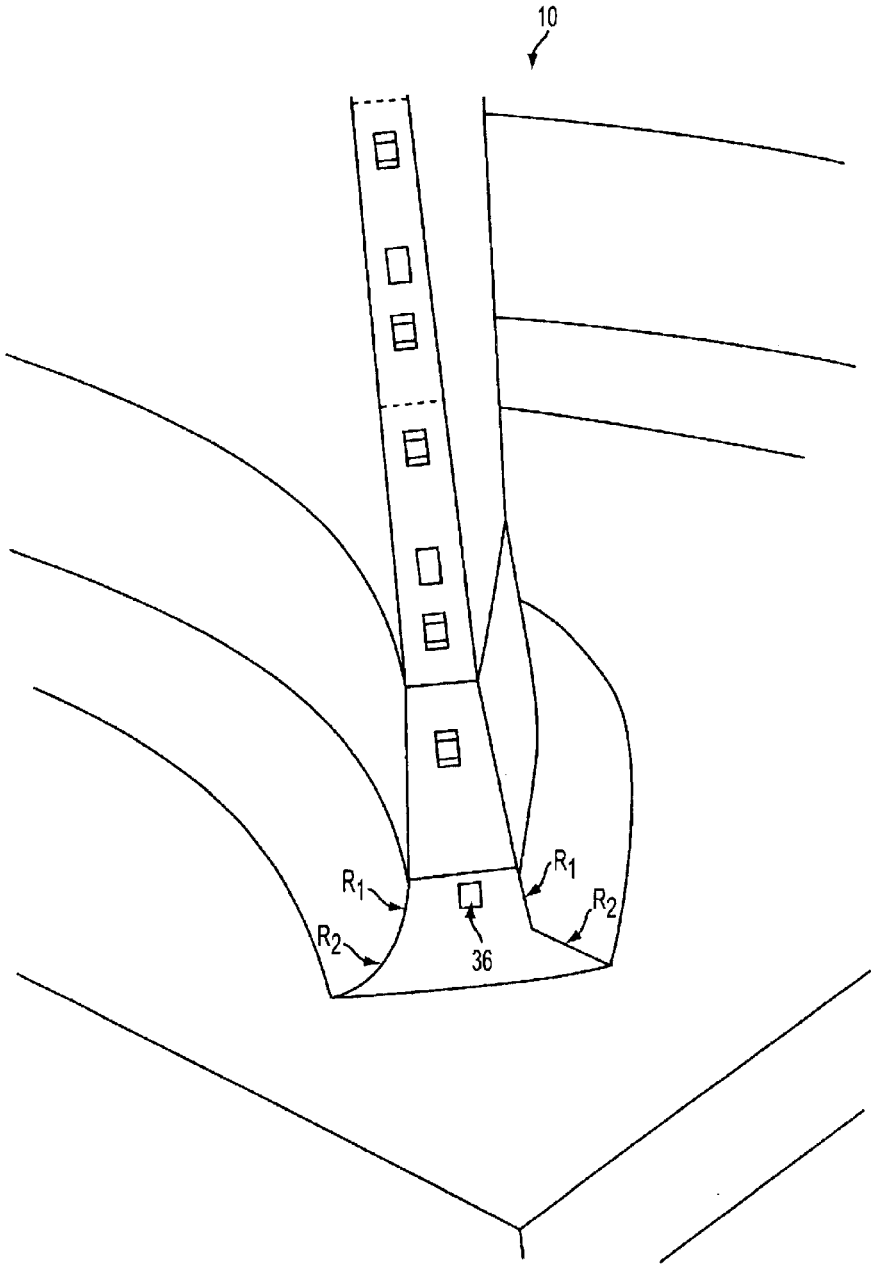
FIG. 3B is a partial end elevation view of an alternate embodiment of the vane segment assembly shown in FIG. 3A.

With continued reference to FIG. 3A, the outer boundary 74 of each transition zone 44 is curved, characterized by a concave fillet having a radius R having a value preferably from about 4 mm to about 15 mm. It is noted that the transition zone 44 outer boundary need not be a simple fillet; it may also be characterized by a compound fillet, having two or more radii, with each radii $R_1$, $R_2$, having a size from about 4 mm to about 15 mm and about 45 mm to about 105 mm, as shown in FIG. 3B. Other suitable contours may also be used as desired.

With continued reference to FIG. 3A, each blending zone 46 is a tapered region having outer boundaries 76 that are linear, yet angled with respect to the center plane $P_C$ of the body portion 14. Preferably, the angle ø is in the range of about 1 degree to about 10 degrees, with the optimum value being about 5 degrees. As such, each blending zone 46 has a substantially frusto-conical cross-section which resembles an essentially-isosceles triangle having a height H that is up to ⅓ of the distance between shroud ends.

This arrangement increases the contact area between the body portions 14 and the shroud portions 16,18 while simultaneously addressing a major hurdle typically associated with reducing heat transfer rate through the addition of mass. By including blending zones 46 along the cooled portion of the body portion 14, the end regions 38,40 of present invention 10 provide unique benefits. The end regions 38,40 not only ensure heat is transferred from the shroud portions 16,18 to the body portions 14 at a moderate rate which does not induce cracks, they beneficially produce an area of increased mass that is not prone to storing heat. Furthermore, by locating the first transition portion 44 along the body portion 12, the present invention advantageously maintains efficient airflow characteristics throughout the turbine 27. In this application, the term "moderate" heat flow rate will refer to a rate having the value sufficient to resist cracking and may be material-dependent value, such as α, the coefficient of thermal expansion.

With the present arrangement, the transition and blending zones 44,46 cooperatively provide vane segment end regions 38,40 that have enhanced stress resistance properties. The body portion end regions 38,40 employ a geometry that not only resists formation of cracks due to mechanical loads, but also resists cracks due to thermal gradients.

Figure 4:
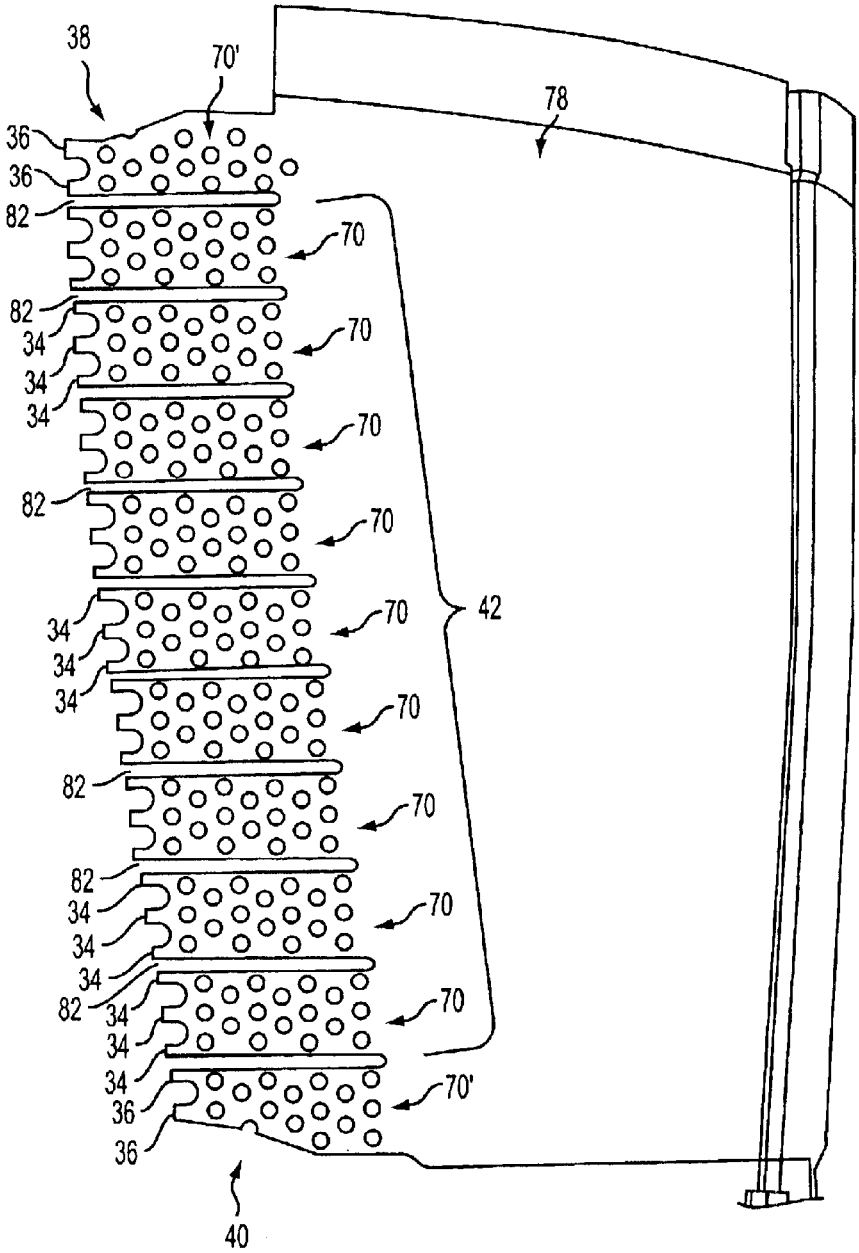
FIG. 4 is an elevation view of a manufacturing core for vane segment assembly according to the present invention, showing a negative image of internal contours laying along cutting line IV—IV' of FIG. 3A.

In keeping with the objects of the invention, the vane segment assembly 10 of the present invention also includes features that substantially reduce cooling-based thermal gradients within the shroud portion/blade interface regions 48,50. The vane segment assembly 10 is internally cooled and, as seen in FIG. 4, includes a hollow cooling chamber 78 which directs fluid, such as air discharged from the compressor section 80, to cool the body portion 14. A cooling chamber entrance 72 provides a conduit through which the cooling fluid enters the cooling chamber 78. The cooling chamber entrance 72 may be located in a variety of locations, including the outer shroud or other suitable locations within the body portion 14.

With continued reference to FIG. 4, the cooling chamber 78 is divided into a number of cooling channels 70, 70' by partitions 82 that extend into the cooling chamber 78 from the body portion trailing edge 30. Although the partitions 82 are described as extending from the trailing edge 30, they may span other regions of the cooling chamber 78 [such as], and need not be included if so desired.

It is noted that while internal cooling is broadly known in this field, the present invention 10 is, with the end region arrangement described above, uniquely suited for a cooling arrangement having cooling exits strategically positioned to reduce the thermal gradient-induced component of the composite stress acting upon the shroud/body body portion interface regions 48,50. Accordingly, each cooling channel includes several cooling channel exits 34,36 with the quantity and size of exits varying in accordance with the location of the channel 70,70' within the body portion 14. More particularly, the channels 70' in the body portion end regions 38,40 include fewer exits 36 than the channels 70 of the body portion mid region 42, and the locations nearest shroud/body interfaces 48,50 do not include cooling channel exits. In one embodiment, the cooling channel exits 36 in the end regions 38, 40 are spaced apart a distance D (between 5 mm–7 mm) from the interface; this spacing may vary from about 4 mm to about 12 mm. Preferably, with reference to FIGS. 3A and 3B, the end region cooling channel exits 36 do not span between the transition zone 44 and blending zone 46.

Heat from the shrouds 16,18 which would otherwise be dissipated by interaction with cooling channel exits 36 located immediately next to the shroud/body interfaces 48,50 is advantageously dispersed and transmitted through the transition and blending zones 44,46, with these regions allowing for effective transfer of the shifted heat without unduly stressing the component. As noted above, cooling channel exits induce thermal stresses, due to the localized thermal gradients they generate. By removing cooling exits from the regions most near the shroud/body interfaces 48,50, the present invention 10, in keeping with the objects of the invention, advantageously removes a source of localized thermal stresses from those regions.

With continued reference to FIG. 4, the end region cooling channel exits 36 are larger than the mid region cooling channel exits 34, such that the total volume circumscribed by the exits in each of the various channels 70,70' is substantially equal. With this arrangement, although the cooling distribution within the end region channels 70' differs slightly from the cooling distribution within the mid region channels 70, the mass flow of cooling fluid through the channels is essentially the same. This arrangement maintains necessary cooling within the body portions 14 and reduces the impact of thermal gradients within the shroud/body interface regions 48,50, thereby reducing the thermal gradient component of composite stress in this highly-stressed area. In this manner, the transition and blending zones 44,46 interact synergistically with the strategically-distributed cooling channel exits 34,36 to further increase the crack resistance properties of the present invention. As a result, the present invention reduces the composite stress levels at the shroud/body interfaces 48,50 without requiring performance-impacting reductions in overall operating temperature or reducing the effectiveness of the cooling fluid flow.

Additionally, it is to be noted that the present invention reduces composite stress without requiring efficiency-reducing increases in cooling fluid flow, modifications to other engine components, or performance-reducing operational limitations, thereby making the present invention especially well-suited for use in retrofit situations, in which the performance of existing equipment is improved. It is also noted that the present cooling arrangement could be used without the blending and transition regions 44,46 of the present invention; however, combining these elements enhances the effectiveness of each of them. It is also noted that although the vane segment assembly 10 of the present invention is especially suited for use in the second stage 24 of an industrial gas turbine expander section 26, it will reduce the stresses acting upon vanes situated in other locations, as well.

It is to be understood that while certain forms of the invention have been illustrated and described, it is not to be limited to the specific forms or arrangement of parts herein described and shown. It will be apparent to those skilled in the art that various, including modifications, rearrangements and substitutions, may be made without departing from the scope of this invention and the invention is not to be considered limited to what is shown in the drawings and described in the specification. The scope if the invention is defined by the claims appended hereto.

What is claimed is:

1. A vane segment assembly member for a gas turbine engine comprising:

a body portion having a first end region spaced apart from a second end region by a mid region extending therebetween, each of said end regions including a transition zone and a blending zone, said transition zones each being characterized by a first outer contour, and said blending zones each being characterized by a second outer contour;

a first shroud portion adjacent said first end region;

a second shroud portion adjacent said second end region;

a cooling chamber disposed within said body portion, said cooling chamber including a cooling channel entrance adapted for fluid communication with a source of cooling fluid, said chamber being characterized by a first cooling channel having a first number of cooling exits in fluid communication with said first and region and a second cooling channel having a second number of cooling exits in fluid communication with said mid region, wherein the total volume circumscribed by said first number of exits is substantially-equal the total volume circumscribed by said second number of exits, wherein said transition zone and said blending zone cooperatively form a region adapted to facilitate transfer of heat at a rate effective to resist crack propagation within said body portion without storing heat and wherein said cooling exits are adapted and arranged to cool said body portion without inducing local thermal gradients adjacent said shrouds.

2. The vane segment assembly member of claim 1, wherein said exits are located outside of said transition zone.

3. The vane segment assembly member of claim 1, wherein one of said exits are located adjacent said shrouds.

4. The vane segment assembly member of claim 1, wherein said exits of claim 1, wherein said exits are spaced apart from said shrouds by a distance equal to at least about 4 mm.

5. The vane segment assembly member of claim 1, wherein said second number is greater than said first number.

6. The vane segment assembly member of claim 1, wherein said second end region includes an exit channel characterized by a third number of exits.

7. The vane segment assembly member of claim 1, wherein said blending zone is cooled by said cooling exits of said end first end region.

8. The vane segment assembly member of claim 1, wherein said mid region includes a plurality of exit channels.

9. The vane segment assembly member of claim 1, wherein each of said blending zones is adjacent said mid region and each of said transition zones is between a corresponding one of said blending zone and a corresponding one of said shrouds.

10. The vane segment assembly member of claim 1, wherein said first outer contour is curved.

11. The vane segment assembly member of claim 10, wherein said curved outer contour has a radius measuring in the range of about 4 mm to about 12 mm.

12. The vane segment assembly member of claim 1, wherein said second outer contour is substantially-linear.

13. The vane segment assembly member of claim 12, wherein said second outer contour defines an angle with respect to a center plane of said body portion having a value in the range of about 1 degree to about 20 degrees.

14. A vane segment assembly member for a gas turbine engine comprising:

a body portion having a first end region spaced apart from a second end region by a mid region extending therebetween, each of said end regions including a transition zone and a blending zone, said transition zones each being characterized by a first outer contour, and said blending zones each being characterized by a second outer contour, wherein said first outer contour is a compound fillet;

a first shroud portion adjacent said first end region;

a second shroud portion adjacent said second end region;

a cooling chamber disposed within said body portion, said cooling chamber including a cooling channel entrance adapted for fluid communication with a source of cooling fluid, said chamber being characterized by a first cooling channel having a first number of cooling exits in fluid communication with said first end region and a second cooling channel having a second number of cooling exits in fluid communication with said mid region.

whereby said transition zone and said blending zone cooperatively form a region adapted to facilitate transfer of heat at a rate effective to resist crack propagation within said body portion without storing heat and wherein said cooling channel exits are adapted and arranged to cool said body portion without inducing local thermal gradients adjacent said shrouds.

15. The vane segment assembly member of claim 14, wherein said compound fillet is characterized by a first radius measuring in the range of about 4 mm to about 15 mm and a second radius measuring in the range of about 45 mm to about 10 mm.

16. A vane segment assembly member for a pass turbine engine comprising:

a body portion having a first end region spaced apart from a second end region by a mid region extending therebetween, each of said end regions including a transition zone and a blending zone, said transition zones each being characterized by a first outer contour, and said blending zones each being characterized by a second outer contour;

a first shroud portion adjacent said first end region;

a second shroud portion adjacent said second end region;

a cooling chamber disposed within said body portion, said cooling chamber including a cooling channel entrance adapted for fluid communication with a source of cooling fluid, said chamber being characterized by a first cooling channel having a first number of cooling exits in fluid communication with said first and region and a second cooling channel having a second number of cooling exits in fluid communication with said mid region, wherein the total volume circumscribed by said first number of exits is substantially-equal the total volume circumscribed by said second number of exits, wherein said exits are located substantially inside of said transition zone, whereby said transition zone and said blending zone cooperatively form a region adapted to facilitate transfer of heat at a rate effective to resist crack propagation within said body portion without storing heat and wherein said cooling exits are adapted and arranged to cool said body portion without inducing local thermal gradients adjacent said shrouds.

* * * * *